US009523165B2

(12) United States Patent
Crispino

(10) Patent No.: US 9,523,165 B2
(45) **Date of Patent: *Dec. 20, 2016**

(54) BED COVERING PRODUCT AND METHOD OF MANUFACTURE

(71) Applicant: KaDe Enterprises LLC, Bristol, CT (US)

(72) Inventor: Kathleen Crispino, Bristol, CT (US)

(73) Assignee: KaDe Enterprises LLC, Bristol, CT (US)

( * ) Notice: Subject to any disclaimer, the term of this patent is extended or adjusted under 35 U.S.C. 154(b) by 61 days.

This patent is subject to a terminal disclaimer.

(21) Appl. No.: 14/145,930

(22) Filed: Dec. 31, 2013

(65) Prior Publication Data

US 2014/0189952 A1 Jul. 10, 2014

Related U.S. Application Data

(60) Provisional application No. 61/848,353, filed on Dec. 31, 2012.

(51) Int. Cl.
*A47G 9/02* (2006.01)
*D05B 19/02* (2006.01)

(52) U.S. Cl.
CPC ..... *D05B 19/02* (2013.01); *A47G 9/02* (2013.01)

(58) Field of Classification Search
CPC ..... A47G 9/02; A47G 9/0238; A47G 9/0284; D05B 19/02
See application file for complete search history.

(56) References Cited

U.S. PATENT DOCUMENTS 4,304,018 A * 12/1981 McClam ..... A47G 9/0238 5/485
5,321,862 A * 6/1994 Campbell ..... A47C 21/022 5/482
5,884,349 A * 3/1999 Gretsinger ..... A47G 9/02 5/494
6,502,285 B2 * 1/2003 Kiely ..... A44B 19/38 24/415
6,886,197 B1 * 5/2005 Madigan ..... A47G 9/02 5/482
7,290,301 B2 * 11/2007 Ho ..... A47G 9/02 5/482
7,849,534 B2 * 12/2010 Bellick ..... A47G 9/086 5/413 R (Continued)

*Primary Examiner* — Nicholas Polito
*Assistant Examiner* — Eric Kurilla
(74) *Attorney, Agent, or Firm* — Damian Wasserbauer Esq.; Wasserbauer Law LLC

(57) ABSTRACT

A bed covering product, system and a process of manufacturing such product is disclosed to form a one-piece, multi-panel upper and lower sheet assembly. The lower sheet fits on a mattress in a removable manner and the upper sheet is connected to the lower sheet through expandable flaps of material made from elastic, stretchable material. An expansion flap zipper runs between the sides of the upper and lower sheets so as to close the assembly when it is zipped, whereby the upper sheet is pulled tightly against the lower sheet but when it is opened by unzipping the upper sheet is allowed to move away from the lower sheet to the extent of the expandable flaps of material. Another release zipper is disposed adjacent the expansion flap zipper and interior for allowing laundering the upper and lower sheets separately.

4 Claims, 8 Drawing Sheets

(56) References Cited

U.S. PATENT DOCUMENTS

| | | | | |
|---|---|---|---|---|
| 2007/0271699 | A1* | 11/2007 | Sacchetti | A47G 9/02 5/495 |
| 2010/0107339 | A1* | 5/2010 | Stinchcomb | A47G 9/02 5/502 |
| 2010/0154122 | A1* | 6/2010 | Crispino | A47C 21/028 5/636 |

* cited by examiner

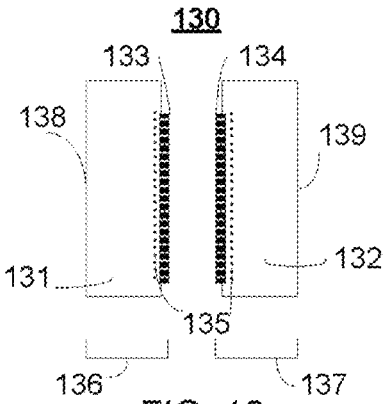
FIG. 12
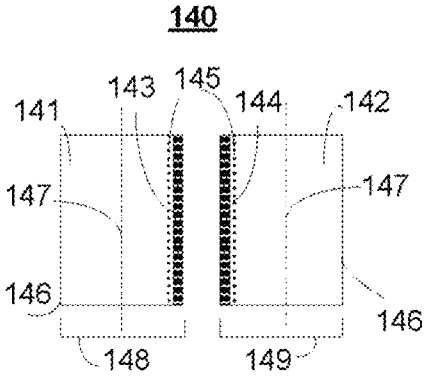
FIG. 14
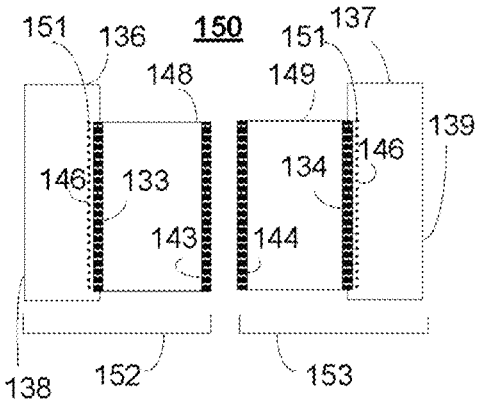
FIG. 16
FIG. 13
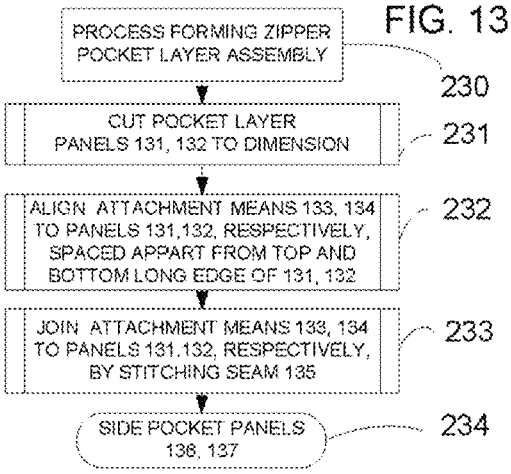
FIG. 15
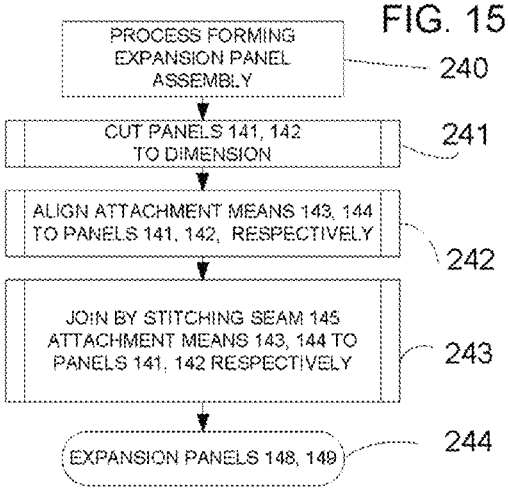
FIG. 17
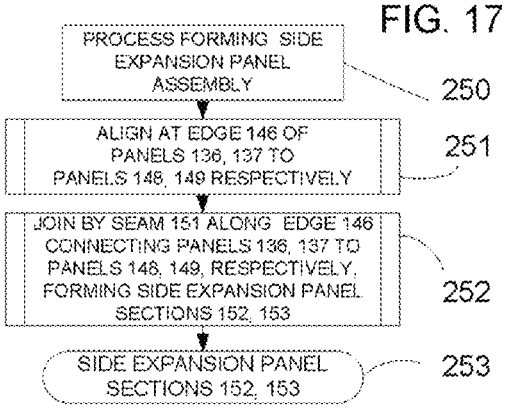

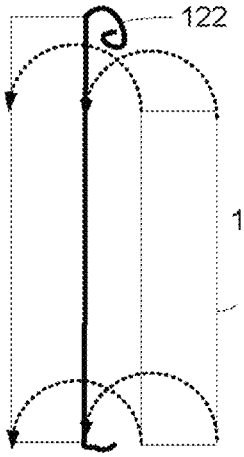
FIG. 22A
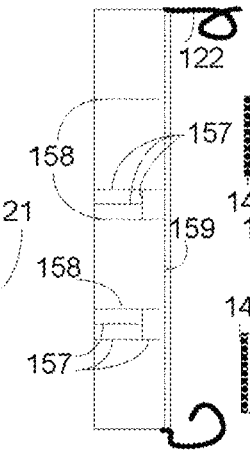
FIG. 22B
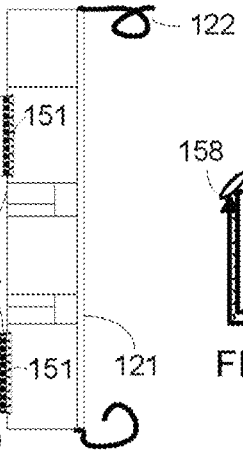
FIG. 22C
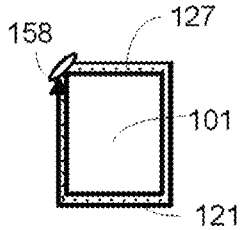
FIG. 22D
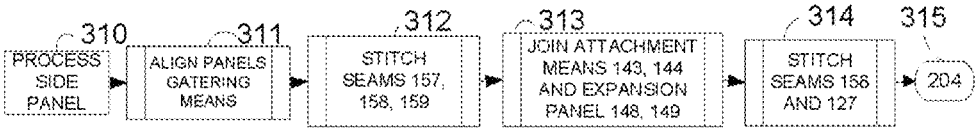
FIG. 23
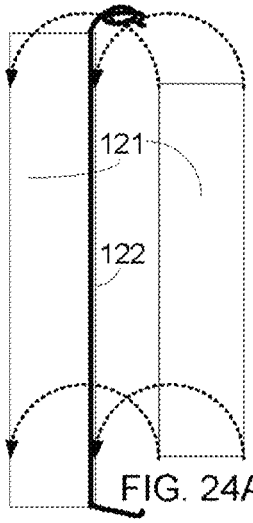
FIG. 24A
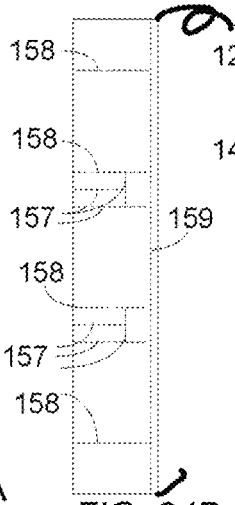
FIG. 24B
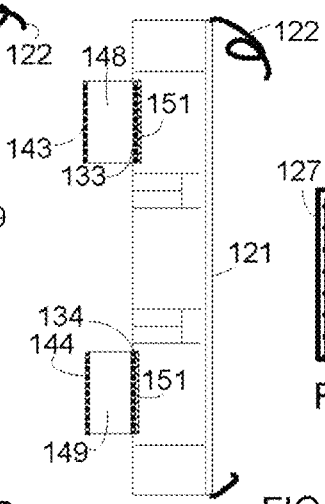
FIG. 24C
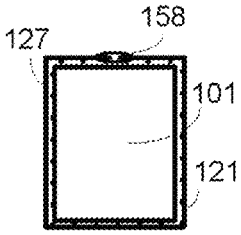
FIG. 24D
FIG. 25
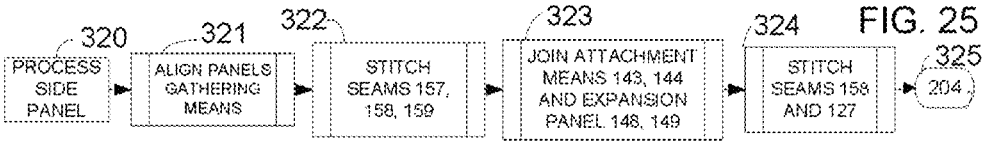

BED COVERING PRODUCT AND METHOD OF MANUFACTURE

PRIORITY

This application claims priority to U.S. Provisional Application No. 61/848,353 filed on Dec. 31, 2012, which is incorporated by reference in its entirety.

BACKGROUND OF THE INVENTION

The present invention relates generally to a bed covering system, an improved process of manufacturing, and a bed covering product made from that process, plus accessories and attachments, that may quickly and efficiently be applied to a bed with minimum physical or cognitive effort.

Manufacturing of bed covers predominantly utilize manual assembly and labor. Automated assembly of a bedding system with multiple panels is limited. There is a need for an improvement in the manufacturing of a multi-panel bed covering. More particularly, the need exists in reducing steps and automation of assembly of a multi-panel bed cover either utilizing sequential steps, or alternatively using multi-processing and multi-threading steps running concurrently. As a result, there is a need for an automated manufacturing process where steps can be scheduled by a computer running instructions placed in its queue to operate cutting, assembling and sewing machines in order to make a multi-panel bed covering product. As a result, there is a long felt need for a process of manufacturing a multi-panel bed covering system and product that minimizes the steps, required materials, and amount of time to make the product.

The bed covering system of the present invention relates to any mattress style bed (with or without a box spring) in a quick, efficient and neat manner. The bedding system allows the user to quickly and easily make a bed in its entirety (sheets, blankets, comforters and pillow(s), placed, balanced and taught), in a repeatable manner using a one or two "zip" process regardless of the users' age, physical restrictions and/or lack of regard to detail.

The system described also adds the safety feature of preventing a child, elderly, convalescent or hospitalized person from falling out of bed once swaddled or tucked in via the "zipper" or fasteners. If unsecured by the zipper, the new bedding system's pocketed design will cradle the fall so that the child and/or adult is less likely to be harmed if they were to fall off of the mattress. The expandable pocket will act as a sling or harness to catch the user falling from the mattress. While the user(s) is sleeping, the described bedding will prevent displacement or removal of the bed linens and pillow(s).

The described system may also provide an attached pocketed organizer for the user's personal items (i.e.: glasses, book, remote control, cell phone, etc.), an opened area for exiting one leg or foot out from under the bedding if desired and vented area(s) in order to cool off without removing the covers.

As is well known, various types of bed coverings such as sheets, blankets and comforters have been used for ages. Generally a lower sheet is applied to the mattress. The lower sheet can be flat and tucked around the mattress or "fitted" to the mattress. An upper sheet is then applied by tucking it around the mattress which is now covered with the lower sheet. After this, a blanket or blankets are positioned over, and then tucked around the sheet covered mattress and the comforter or top covering is then positioned on top of the entire assembly, usually by neatly draping it over the assembly.

The main problems with the typical bedding described above are that the various pieces (i) are time consuming to apply and reapply correctly, (ii) require substantial work, often strenuous to back muscles, to apply and remake correctly, (iii) easily come undone from the bed (i.e.: if sat on, jumped on, slept in or via any other disturbance), (iv) are difficult to position correctly and keep neat, and (v) often require repeated access to various parts of the bed to position. Various attempted improvements have been suggested. In this regard, please refer to U.S. Pat. No. 4,304,018 to McClam; U.S. Pat. No. 5,794,285 to Burch; U.S. Pat. No. 5,884,349 to Gretsinger; U.S. Pat. No. 6,427,266 to Talley-Williams; U.S. Pat. No. 6,490,741 to Wheeler; U.S. Pat. No. 6,502,285 to Kiely; U.S. Pat. No. 6,886,197 to Madigan; U.S. Pat. No. 7,849,534 to Campbell; and published application WO 2007/0232256 A1 to Thompson. While these suggested improvements claim to solve some of the foregoing problems, none of them effectively address all of the issues and as a result they have not met with substantial commercial success.

Thus the bed covering system, improved process of manufacturing, and bed covering product made from that process, proposed by this invention resolves the issues that have arisen from the making of, sleeping in, washing, and reapplying as well as resolving the absence of any safety features that target various at risk groups mentioned above of existing bedding systems. In doing so the proposed invention significantly departs from conventional concepts and designs for bedding and is designed to assist the user(s) in quickly, efficiently and neatly securing the bedding materials to the bed, in an aesthetic manner with little likelihood of disturbing the finished aesthetics without the user choosing to do so.

SUMMARY OF THE INVENTION

It is an object to this invention to disclose a process of manufacturing a bed covering product and multi-panel, one piece system including features of a pocket organizer(s), a vent at the foot and/or sides of the bed, an attachment means such as a zipper for opening and closing the bed covering joining the upper and lower sheets, an additional attachment means such as a release zipper for detaching the upper and lower sheets for laundering, a pillow attachment, plus other accessories and attachments that may quickly and efficiently be applied to a bed, and removed, with minimum physical or cognitive effort.

It is an object to this invention to disclose a process of manufacturing the bed covering system that advantageously minimizes the amount of time necessary to make the product as well as to reduce and optimize the steps in each of the manual and automated environments.

It is yet another object to this invention to disclose a process of manufacturing the bed covering system that advantageously minimizes the material required to make the bed covering system.

It is a further object to provide a process of making a bedding product adapted to have a release zipper for detaching the upper and lower sheets with this additional attachment means advantageously allows laundering separately. The additional release zipper is aligned adjacent the zipper used to open and close the bedding product and interior, for example, hidden on the inside when the upper and lower sheets zipped to the closed position.

These and other objectives and advantages are achieved by a process of manufacturing a bed covering system that comprising the steps of:

(A) Joining a lower sheet and a side panel assembly shaped to fit upon and substantially cover the top, sides and a portion of the underside of any mattress by stitching the side panel assembly to a peripheral edge of the lower sheet to form a lower layer assembly;

(B) Joining the lower layer assembly and an expansion panel by stitching the expansion panel to an edge of the side panel assembly on opposite sides of the bed; the side panel assembly configured place the expansion panel along a side of the bed;

(C) Joining an upper sheet to the expansion layer so as to attach the expansion layer both the lower sheet and upper sheet; and (D) Joining at least one attachment means to the edge of the side panel and the upper sheet so as to allow opening and closing the bed covering system.

These and other objectives and advantages are achieved by a process of manufacturing a bed covering product comprising:

(a) a lower sheet, comprising a major surface and four sides of a head, a front, and two sides where persons enter and exit the bed, shaped to fit upon and substantially cover the top and side portions of a mattress such that the lower sheet removably attaches to the mattress, and a pocket on at least the two sides;

(b) an upper sheet, comprising a major surface and four edges, that is attached to the lower sheet on the two sides through expandable flaps of material, wherein the expandable flaps of material comprise an elastic fabric which stretches when force is applied and located along the two sides;

(c) at least one attachment means which, can be open or closed, and attaches the upper sheet to each of the two sides of the lower sheet;

wherein when the attachment means is closed the upper sheet is pulled tightly against the lower sheet and the expandable flaps of material tuck, fold or contract neatly along the two sides of a bed so that each of the expandable flaps of material are hidden and pulled together behind the attachment means in the pocket of the lower sheet, but when the attachment means is open it allows the upper sheet to move away from the lower sheet to the extent allowed by the expandable flap of material.

Other features of the present invention will be apparent from the accompanying drawings and from the detailed description which follows.

BRIEF DESCRIPTION OF THE DRAWINGS

Non-limiting and non-exhaustive embodiments of the present invention are described with reference to the following drawings. In the drawings, like reference numerals refer to like parts throughout the various figures unless otherwise specified.

For a better understanding of the present invention, reference will be made to the following Description of the Embodiments, which is to be read in association with the accompanying drawings, which are incorporated in and constitute a part of this specification, show certain aspects of the subject matter disclosed herein and, together with the description, help explain some of the principles associated with the disclosed implementations, wherein:

The present invention is illustrated by way of example and not limitation in the figures of the accompanying drawings in which like references indicate similar elements of the bed covering product, system and process of manufacturing and should not be considered limiting the scope of the invention.

FIG. 1 is an expanded view of bed covering system proposed in this invention.

FIG. 2 is a view of the bedding materials as applied to a made up bed.

FIG. 3 is a view showing the underside of the mattress in one embodiment.

FIG. 4 is a schematic view illustrating the bed covering system;

Figure 1:
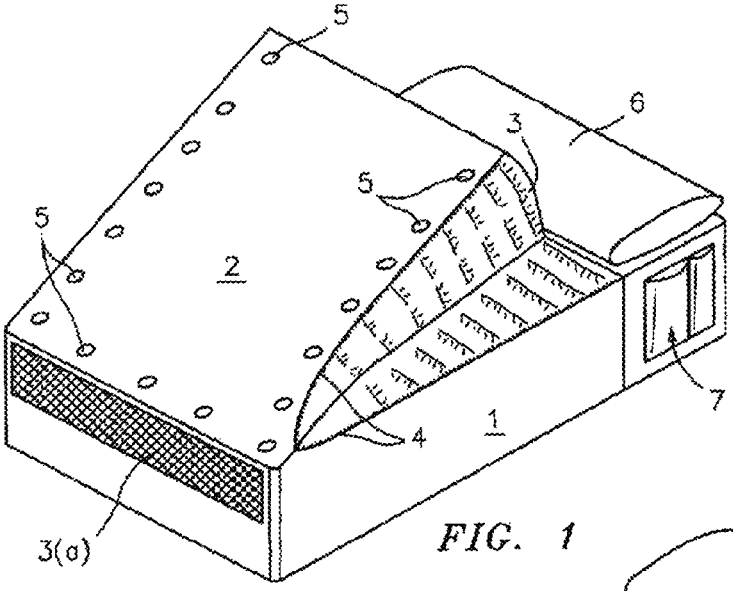
Figure 2:
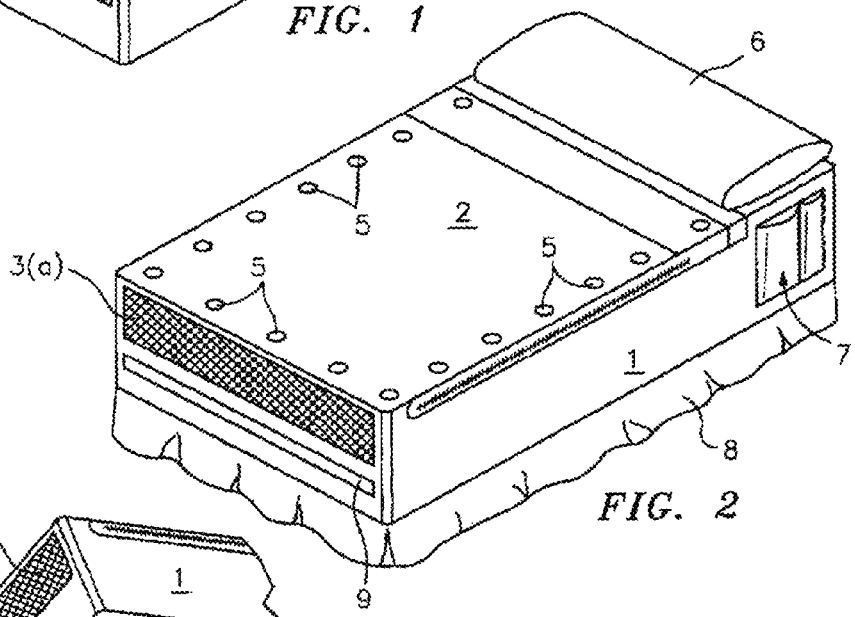
Figure 3:
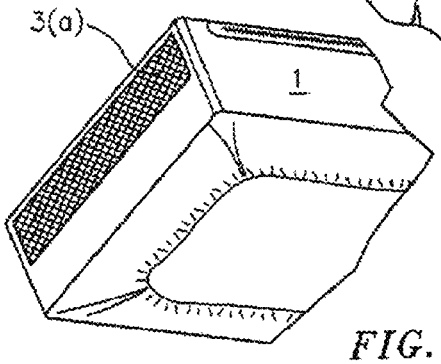
Figures 4, 5A, 5B, 5C:
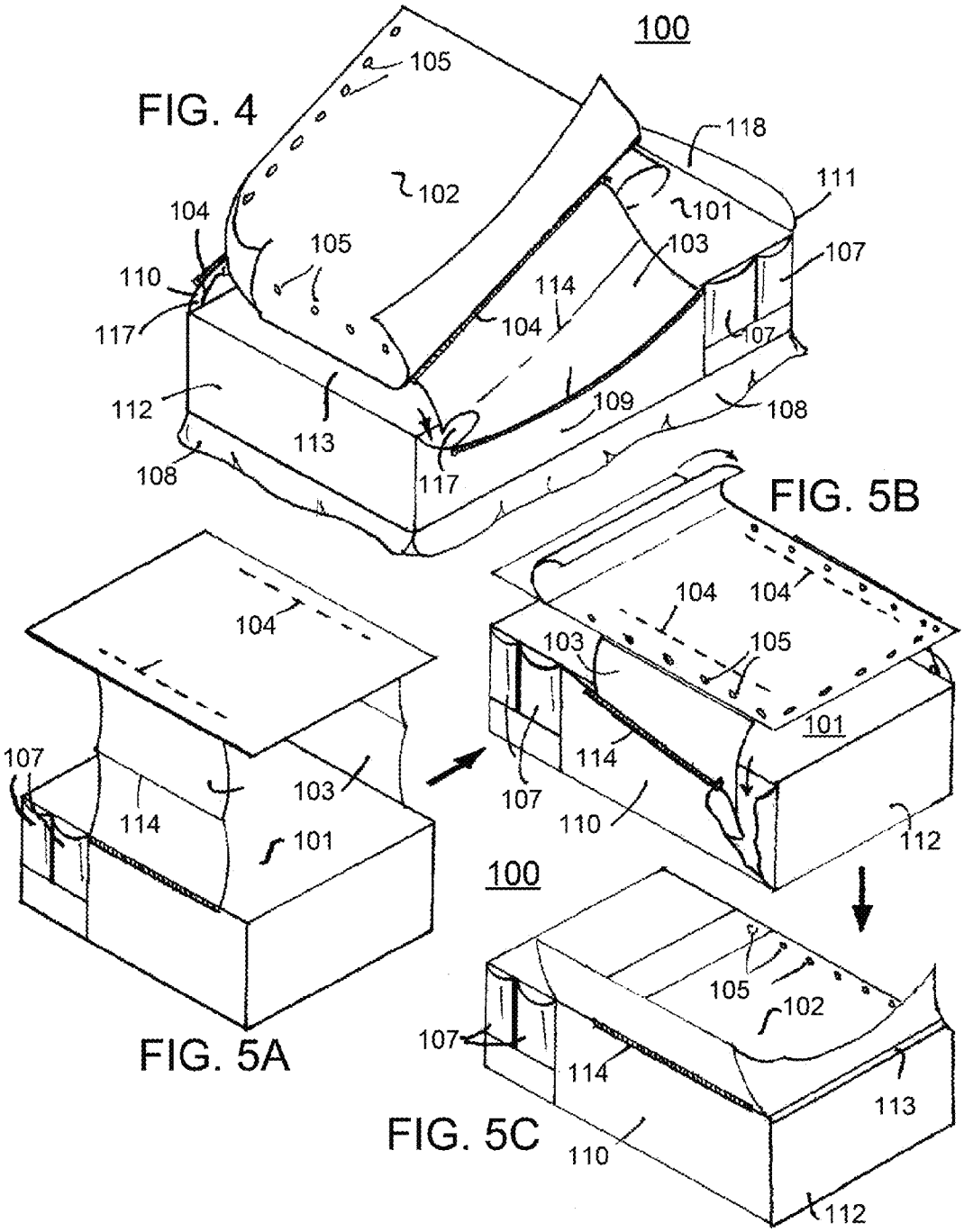
Figure 6:
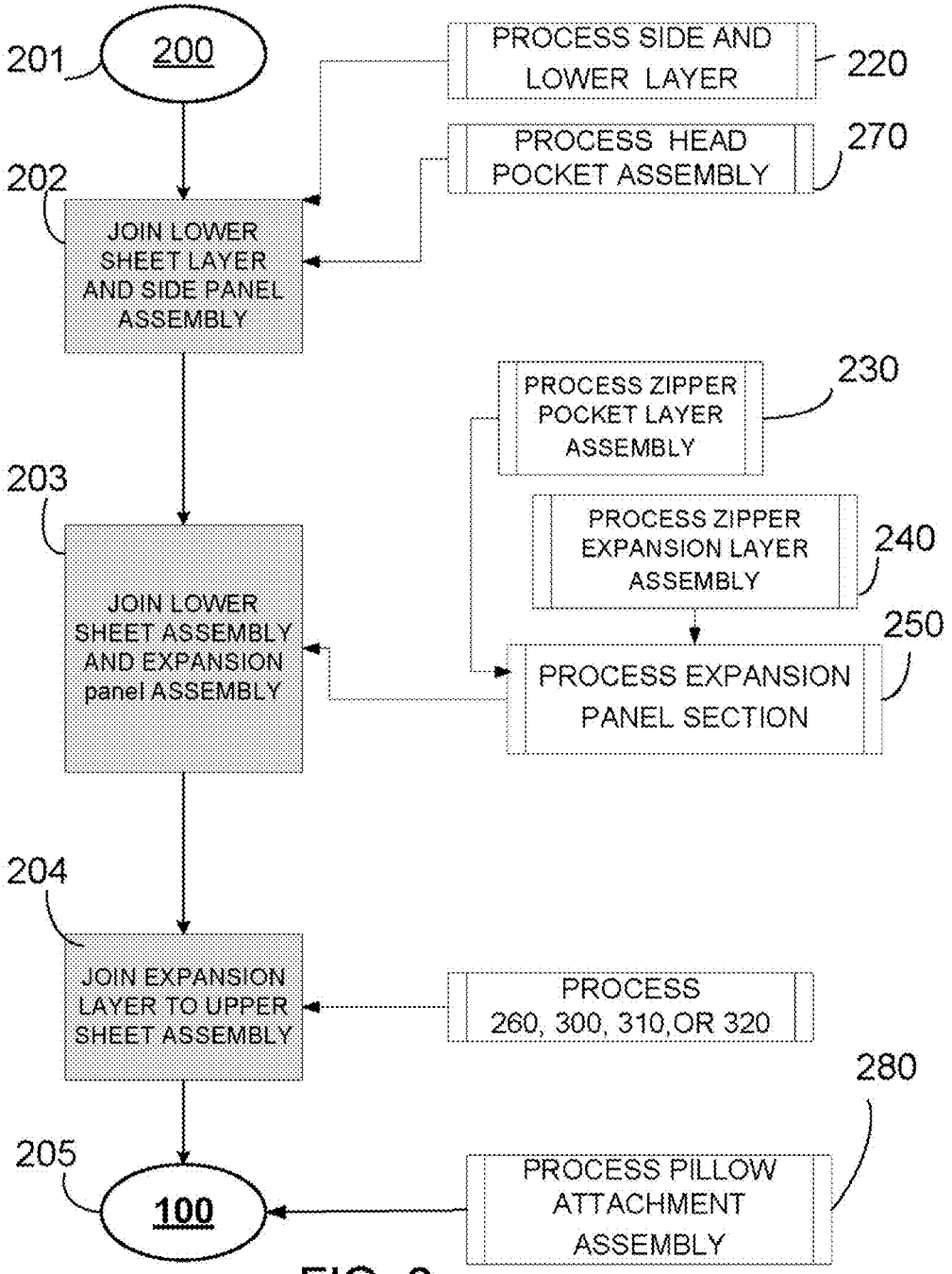
Figure 7:
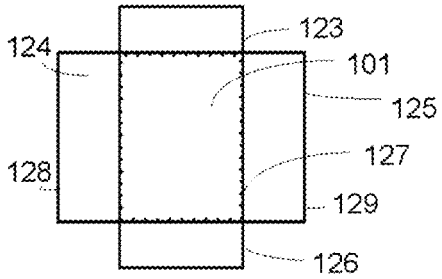
Figure 8:
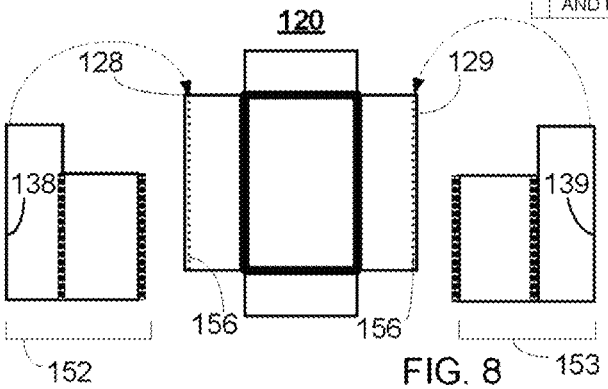
Figure 9:
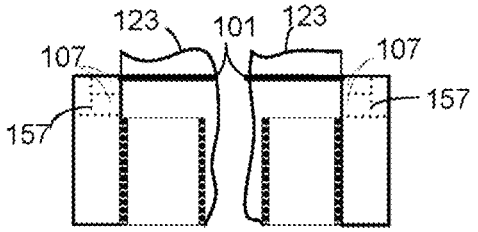
Figure 10:
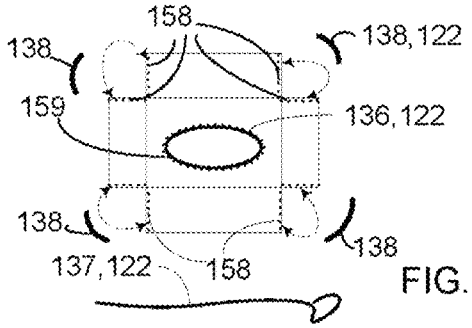
Figure 11:
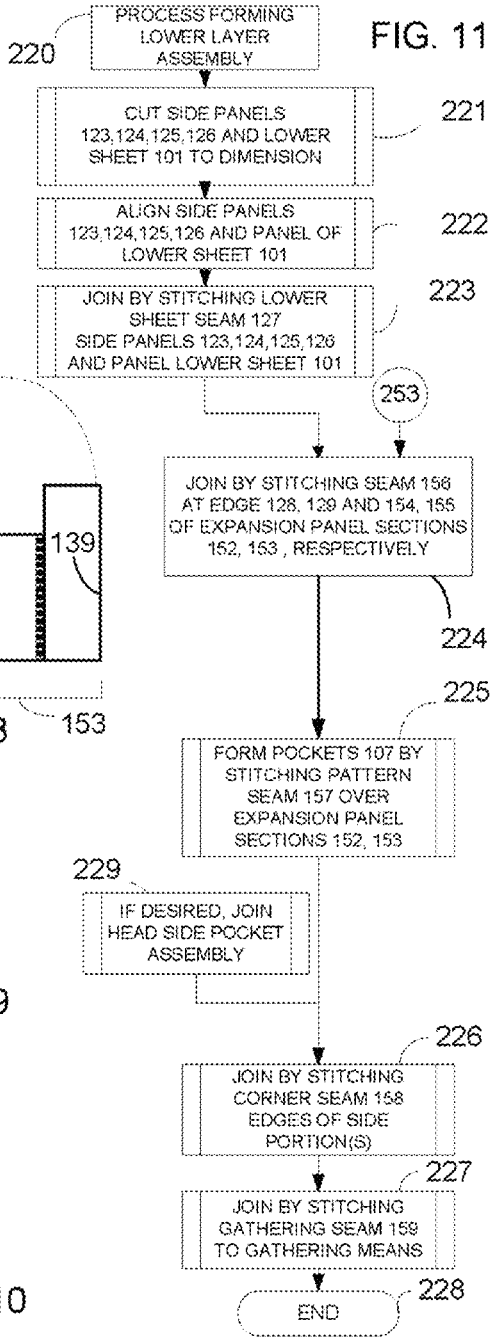
Figure 18A:
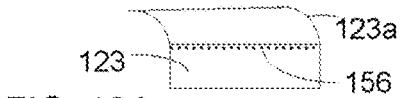
Figure 18B:
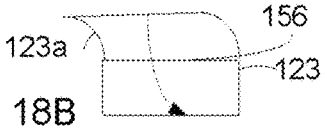
Figure 18C:
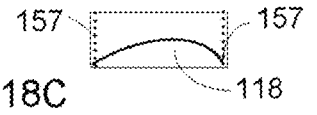
Figure 19:
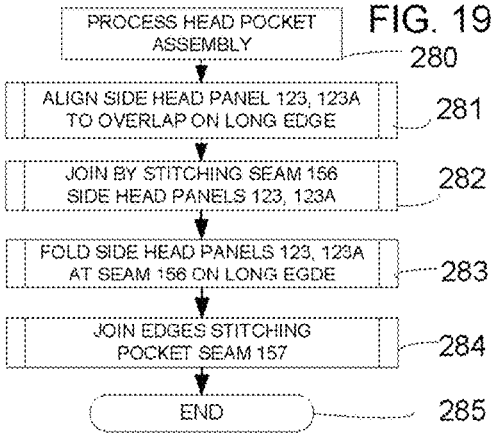
Figure 20A:
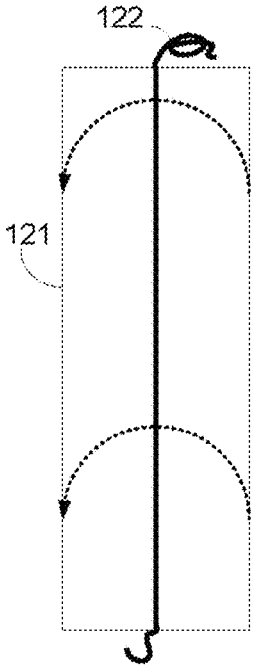
Figure 20B:
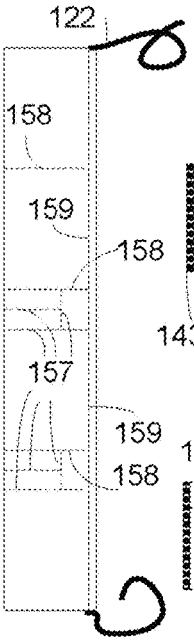
Figure 20C:
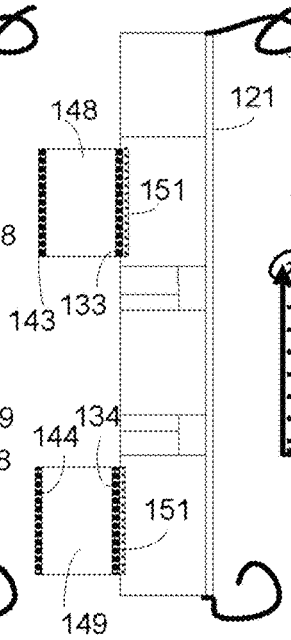
Figure 20D:
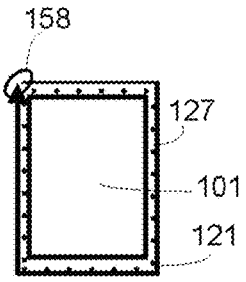
Figure 21:
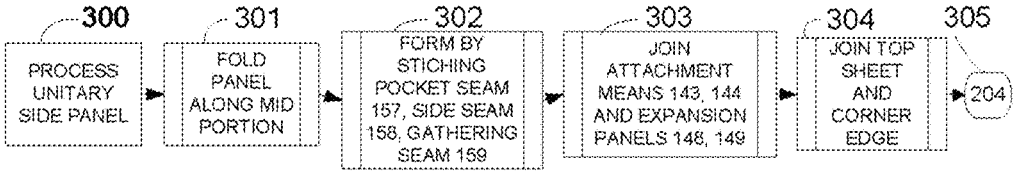
Figure 26:
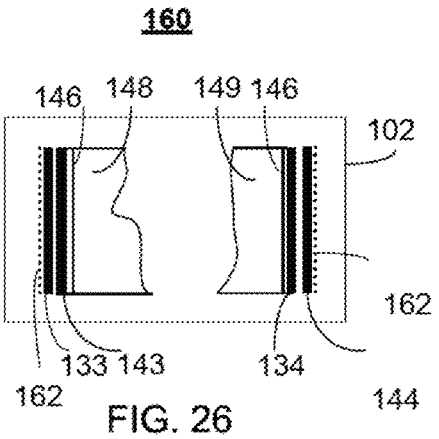
Figure 27:
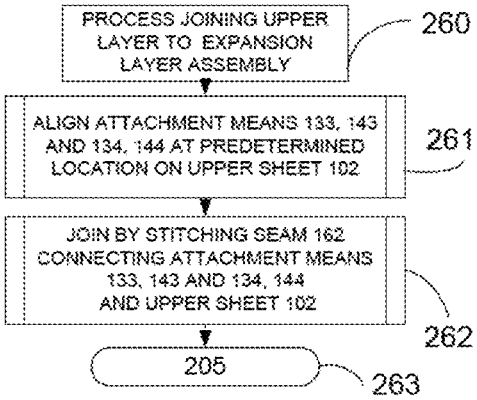
Figure 29:
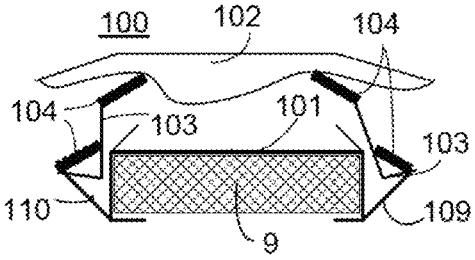
Figure 28:
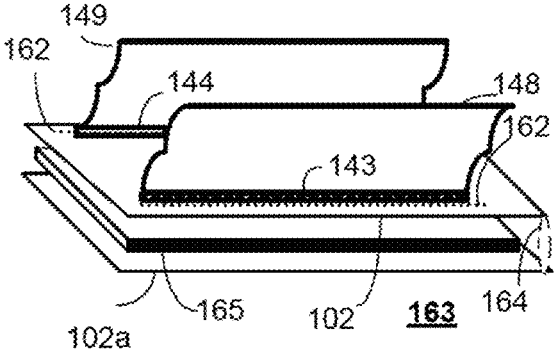
Figure 30:
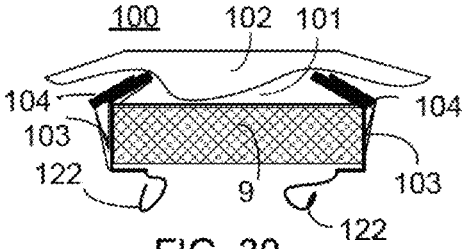
Figure 31:
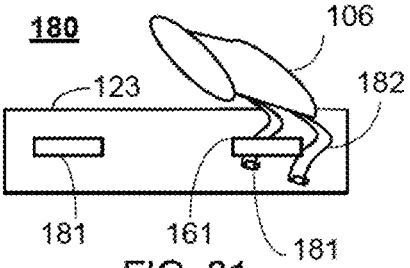
Figure 32:
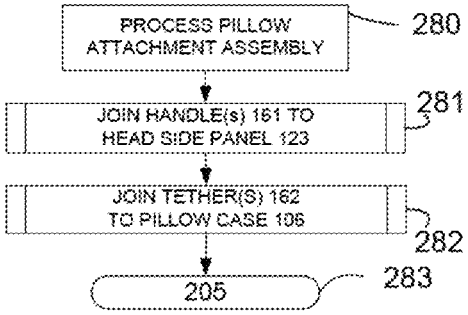

FIGS. 5A, 5B, and 5C are schematic diagrams illustrating the bed covering system between open and closed positions of making the bed;

FIG. 6 is a flow diagram illustrating a process of manufacturing a bed covering product according to an exemplary embodiment;

FIG. 7 is a schematic diagram illustrating the process of forming the lower sheet assembly as shown in FIG. 11;

FIG. 8 is a schematic diagram illustrating the process of forming the lower sheet assembly as shown in FIG. 11;

FIG. 9 is a schematic diagram illustrating the process of forming the lower sheet assembly as shown in FIG. 11;

FIG. 10 is a schematic diagram bottom view illustrating the process of forming the lower sheet assembly as shown in FIG. 11;

FIG. 11 is a flow diagram illustrating the process of manufacturing the lower sheet of the bed covering product;

FIG. 12 is a schematic diagram illustrating a process of forming a zipper pocket layer assembly as shown in FIG. 13;

FIG. 13 is a flow diagram illustrating a process of forming a zipper pocket layer assembly:

FIG. 14 is a schematic diagram illustrating a process of forming a zipper expansion layer assembly as shown in FIG. 15;

FIG. 15 is a flow diagram illustrating a process of forming a zipper expansion layer assembly;

FIG. 16 is a schematic diagram illustrating a process of firming an expansion layer assembly as shown in FIG. 17;

FIG. 17 is a flow diagram illustrating a process of forming an expansion layer assembly;

FIGS. 18A, 18B, and 18C are schematic diagrams illustrating a process of forming a head pocket assembly as shown in steps FIG. 19;

FIG. 19 is a flow diagram illustrating a process of forming a head pocket assembly:

FIGS. 20A, 20B, 20C and 20D are schematic diagrams illustrating a process of forming unitary side panel assembly as shown in FIG. 21;

FIG. 21 is a flow diagram illustrating a process of forming a head pocket assembly:

FIGS. 22A, 22B, 22C and 22D are schematic diagrams illustrating a process of forming a side panel assembly from multiple panels as shown in FIG. 23;

FIG. 23 is a flow diagram illustrating a process of forming a side panel assembly;

FIGS. 24A, 24B, 24C and 24D are schematic diagrams illustrating a process of forming a side panel assembly as shown in FIG. 25;

FIG. 25 is a flow diagram illustrating a process of forming a side panel assembly;

FIG. 26 is a schematic diagram illustrating a process of joining an upper layer to an expansion layer assembly as shown in FIG. 27;

FIG. 27 is a flow diagram illustrating a process of joining an upper layer to an expansion layer assembly;

FIG. 28 is a schematic diagram illustrating an upper layer of the bed covering system;

FIG. 29 is a schematic diagram illustrating the operation of an open expansion layer of the bed covering system;

FIG. 30 is a schematic diagram illustrating the operation of a closed expansion layer of the bed covering system;

FIG. 31 is a schematic diagram illustrating a process of forming a pillow attachment assembly as shown in FIG. 32;

FIG. 32 is a flow diagram illustrating a process forming a pillow attachment assembly.

DETAILED DESCRIPTION OF THE INVENTION

Non-limiting embodiments of the present invention will be described below with reference to the accompanying drawings, wherein like reference numerals represent like elements throughout. While the invention has been described in detail with respect to the preferred embodiments thereof, it will be appreciated that upon reading and understanding of the foregoing, certain variations to the preferred embodiments will become apparent, which variations are nonetheless within the spirit and scope of the invention.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "some embodiments", "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are provided for the purposes of illustrating some embodiments of the present invention, and are not to be considered as limitation thereto. Term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

As used herein the term "sheet" means various types of bed coverings. Generally a lower sheet is applied to the mattress. The lower sheet can be flat and tucked around the mattress or "fitted" to the mattress. An upper sheet is then applied by tucking it around the mattress which is now covered with the lower sheet. After this, a blanket and/or comforters are positioned over, and then tucked around the sheet covered mattress and the comforter or top covering is then positioned on top of the entire assembly, usually by neatly draping it over the assembly.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification do not necessarily all refer to the same embodiment.

According to one embodiment, as shown in FIGS. 1 through 5A-5C, an improved bed covering system comprises a lower sheet 1 shaped to fit upon a mattress 9 so as to substantially cover the top, side portions, and a partial overlap of the bottom thereof. The bed covering system has an upper sheet 2, an expandable flap 3, and a zipper or attachment means 4 for opening and closing the bed covering system thereby joining the upper and lower sheets and designed to assist the user(s) in quickly, efficiently and neatly securing the bedding materials to the bed, in an aesthetic manner with little likelihood of disturbing the finished aesthetics without the user choosing to do so. Snaps, buttons hoods, Velcro or other connection means 5 can be located on the upper sheet 2 to attach to a comforter, blanket or duvet as desired. A pillow or pillow encasement 6 is located a the head of the bed and can be connected to the bed covering system for case of making the bed and keeping the pillow from falling off.

The bed covering system is a multi-panel, one piece system including features of a pillow or pillow encasement 6 for attaching it to the bed, a pocket organizer(s) 7, a dust ruffle 8, a vent at the foot and/or sides of the bed, a release zipper or additional attachment means used for detaching the upper and lower sheets for laundering, plus other accessories and attachments that may quickly and efficiently be applied to a bed, and removed, with minimum physical or cognitive effort. The lower sheet 1 has a major surface or top, four sides including a head, a foot, and two sides where persons enter and exit the bed. The lower sheet 1 removably attaches to the mattress 9. The lower sheet 1 includes a pocketed side panel on at least the two sides where persons enter and exit the bed for tucking the expandable flap 3 and for safely in catching a person who may roll off the bed.

The upper sheet 2 also has a major surface and four edges. The upper sheet 2 is attached to the lower sheet 1 by zipper 4 adjacent two sides where persons enter and exit the bed. In one embodiment the zipper connects the upper peripheral edge of lower sheet and the outer edge of the upper sheet 2, and alternatively, the zipper 4 connects at a predetermined location at an interior seam line of the major surface so as to allow the upper sheet 2, or comforter, or duvet, to overlap and hang downwardly over the sides and side panel portions. The pocketed side panel on at least the two sides where persons enter and exit the bed are used for tucking the expandable flaps 3 of material, wherein the expandable flaps of material comprise an elastic fabric which stretches when force is applied.

At least one attachment means or zipper 4, which is used to open or close the bed covering system, attaches the upper sheet 2 to each of the two sides of the lower sheet 1. The bedding product also is adapted to have a release zipper or additional attachment means for detaching the upper and lower sheets completely and advantageously to allow for laundering separately the lower sheet 1 and upper sheet 2. The additional release zipper is aligned adjacent the zipper 4 and interior to the major surface, for example, when the upper and lower sheets zipped to the closed position the release zipper will be hidden as with the expandable flaps behind the zipper 4. In operation, when the attachment means or zipper 4 is closed the upper sheet 2 is pulled tightly against the lower sheet 1 and the expandable flaps 3 of material tuck, fold or contract neatly along the two sides of a bed so that each of the expandable flaps 3 of material are hidden and pulled together behind zipper 4 in the pocket of the lower sheet 1 side panel, and when the zipper 4 is open, it allows the upper sheet 2 to move away from the lower sheet 1 to the extent allowed by the expandable flap 3 of stretchable, expandable material.

Referring to FIGS. 6, 7-27, 30, 31, the bed covering product 100 of the present invention can be manufactured advantageously by the following steps or process for forming the lower layer assembly 120, expansion layer assembly 150, and the upper sheet assembly 160. Each assembly 120, 150 and 160 can be formed in discrete steps in order to minimize the amount of waste, sewing, time, costs, and other manufacturing considerations. The expansion layer assembly 150 comprises stretchable material for its expansion panel(s) 103 which allows advantageously the upper sheet 102 to move away from the lower sheet 101 when the attachment means 104 is open. The elastic stretchable material of the expandable panel 103 and side(s) advantageously allows for securing a person comfortably when the attachment means is closed.

The mattress 9 includes mattress and/or mattress-box spring combinations regardless of size, such that it removably, attaches to the mattress and/or box spring and "sheet", including upper sheet and lower sheet shall include mattress or bed coverings made from various fabrics or materials and shall not be limited to typical sheet materials such as cotton or flannel. The attachment means such as a zipper, which runs along at least one edge of the bedding material, such that when the zipper is zipped, the expandable flap of the bedding system tucks neatly along the bed side(s) behind the attachment means, allowing the upper sheet to be pulled tightly against the lower sheet, but when unzipped, allows the upper sheet to move away from the lower sheet to the extent allowed by the expandable flap.

According to one embodiment, a bed covering product 100 illustrated in FIGS. 4, 5A, 5B and 5C, 28, and 29 can be made by the process of manufacturing as is illustrated in FIGS. 6 through 27, 30 and 31. The bed covering product 100 comprises a lower sheet 101, an upper sheet 102, an expandable flap 103, and attachment means 104. Additionally, the bed covering product can include connection means 105 such as, for example, snaps, buttons, hooks, hook-and-loop material and/or fabric available under the trade name of Velcro®, a pillow or pillow encasement, pocket(s) 107, and a dust ruffle 108. For ease of illustration, the side portions of the bed covering product 100 are identified as side portion 109, side portion 110, head side portion 111, and foot side portion 112. A vented area 113 located at a foot end of the mattress by the configuration of the lower sheet 101, upper sheet 102, and expandable flaps 103. Moreover, a fold line 114 is shown to illustrate the opening and closing the bed covering product 100, wherein the expandable flap 103 is tucked into an elongated pocket 117 configured in the side portions 109 and 110, which operation is further shown in FIGS. 5A, 5B and 5C. An additional pocket 118 may be formed along the head portion 111 for storage of larger items that do not fit in the pockets 107 as desired such as books, magazines and the like. An additional release zipper or attachment means 119 for detaching the upper and lower sheets and advantageously allowing laundering separately. The additional release zipper is aligned interior of and adjacent the zipper used to open and close the bedding product, for example, hidden on the inside when the upper and lower sheets zipped to the closed position.

As illustrated FIGS. 5A, 5B and 5C, the operation of the expandable flap 103 for the bed covering product 100 is according to an embodiment of the present invention. The material for the expandable flap 103 panel is stretchable fabric from spandex, cotton/elastic blends and the like. The upper sheet 102 can be expanded from the lower sheet 101 by releasing or un-zipping the zippers 104, for example, when a person is in the bed between flaps 103 and the upper and lower sheets 101 and 102.

Referring to FIG. 5A, the bed covering product 100 can be placed in an open position 115 by releasing the zipper(s) 104 used to secure the lower sheet 101 and upper sheet 102 and extending the expandable flap 103. In FIG. 5A, the expandable flap 103 is shown in an open position 115. A fold line 114 at a mid-portion of expandable flap 103 assists to illustrate its opening and closing operation. When opening or closing, a person will push, tuck, insert, and put the expandable flap 103 in the elongated side pockets 117, thereby locating the flap 103 along the side panels 109 and 110. In order to create a smooth appearance of the side panels 109 and 110 one can locate the fold line 114 at the bottom of the pockets 117, although, in a hastily made bed, the side pockets 117 will nonetheless accept the flap 103 along the side panels 109 and 110 for placing in the closed position 116. Moreover, the bed covering system includes pockets 107 adapted for storage of items useful to the user. Pockets 107 are positioned on a portion of the side panels 109 and 110 so as not to be affected by the action of operation of the expansion flap 103 and side pockets 117, as is illustrated in FIGS. 5A, 5B and 5C. In this manner, pockets 107 advantageously are positioned to remain adjacent to the mattress so as not to spill any contents.

Referring to FIG. 5B, by inserting expandable flaps 103 into the pockets 117 the bed covering product 100 can be put in the closed position 116 from the open position 115. The side pockets 117 are configured to accept flaps 103 along the side panels 109 and 110 (see diagram corner), whereby the flaps 103 are not oriented on top of the mattress. Once the flaps 103 are sufficiently tucked into pockets 117 zippers 104 on each side panel 109 and 110 can engage corresponding zippers 104 disposed on the upper sheet portion 102. Also shown in FIG. 5B, an upper edge of upper sheet 102 can be rotated, folded over to engage corresponding connection means 5 so as to create the desired appearance. It is to be appreciated that the pockets 117 are formed along a portion of the side panels 109 and 110, thereby allowing space for creating pockets 107 for personal items as discussed herein.

In the closed position 116, as illustrated in FIG. 5C, the zippers 104 are engaged to close the bed covering product 100. In the closed position 116, the upper sheet 102 is located on top of the lower sheet 101 with the elongated flaps 103 disposed in pockets 117 and along side panels 109 and 110. As shown in FIG. 5C, lifting a side edge of the upper sheet 102 exposes zipper 104 oriented along the upper edge of the side 110 of a mattress and outer edge of the lower sheet 101. Moreover, an opening or vented area 113 is formed between the lower and upper sheets 101 and 102, respectively, so as to allow the user to extend a foot or leg outside of the bed, as desired. The opening 119 also creates a vented area where the upper sheet 102 is not connected to the lower sheet 101, as advantageous for comfort of the user. In this manner, the bed covering product 100 can provide advantageously superior comfort with an ease of placing in the closed position 117 thereby creating the desired "made bed" appearance.

According to one embodiment illustrated in FIG. 6, a process of manufacturing 200 the bed covering product 100 according to the enumerated steps with individual processes of manufacturing described in greater detail in FIGS. 7 through 27, 30 and 31. The process 200 comprises steps of joining lower layer assembly 120 in step 202, an expansion assembly 140 in step 203, an upper layer assembly 160 in step 204 using techniques such as sewing seams, fusion, and zippers and ends in step 205 with a bed covering product 100 by the process of manufacture. Variations and individual components of assembly can be manufactured by processes 206, 207, 220, 230, 240, 250, 260, 270, 280, 290, 300, 310, and 320 as shown in FIGS. 7, 11, 13, 15, 17, 19, 21, 23, 25, 27 and 31.

Referring to FIG. 6 the process of manufacturing 200 starts at step 201. In step 202 a lower sheet 101 is joined to a side panel assembly 121 to form a lower layer assembly 120. Variations and individual components of each lower layer assembly 120 and side panel assembly 121 can be manufactured by processes 206, 207, 220 and 270, 310, 320 or 330, either performed separately or as part of the overall process. In step 203 the lower layer assembly 120 is joined to an expansion layer assembly 150. Variations and individual components of each expansion layer assembly 150 can be manufactured by processes 230, 240, and 250, either performed separately or as part of the overall process. In step 204 the expansion layer assembly 150 is joined to the upper sheet assembly 160 as shown in FIGS. 6, 26 and 27. In step 205 a bed covering product 100 is completed according the process of manufacture 200 allowing for variations of individual components and features.

The side portion assembly 121 can be manufactured from a single panel, as is illustrated in FIGS. 17 through 20, or multiple panels as illustrated in FIGS. 7-19. The side panel assembly 121 is positioned to extend around the sides and a portion of the bottom of the mattress 9. The side panel assembly 121 functions to secure the lower sheet 101 to an upper surface of the mattress 9 when used by a person.

According to the process 200 in FIG. 6, in step 202, the lower sheet 101 is joined to the side panel assembly 121 creating the lower layer assembly 120 by the combination. As above, the lower layer assembly 120 includes a lower sheet 101, side portion assembly 121 and gathering means 122 so as to form a fitted sheet as shown in FIGS. 1-4, 5A-5C, 7-10, 20A-20D, 22A-22D, and 24A-24D. The material for the lower sheet 101 is suitable sheet material. The material for the side panel assembly 121 is a stretchable material with an elastic component such as, for example, as sold under the trade name Spandex®, cotton elastic blends, elastic woven materials and the like. The material for the gathering means 122 is a drawstring or elastic material in bands, ropes, ribbons or the like.

Joining is used, for example, in joining individual assemblies 120, 150, 160, attachment means such as zippers, attachment means, panels, gathering means such as elastic, drawstrings and the like, edges, and seams. A stitch means at least a single loop of thread or yarn, whether by hand or machine, as is known in the textile arts including a blanket stitch, used to reinforce the edge of thick materials, cable knitting, chain stitch, cross-stitch, embroidery stitch, lockstitch, overlock, or barter stitch used to form welting. Seams can be manufactured by machine in one or more variations of stitches Chain stitch, made with one thread, Lockstitch, made with two threads, Overlock, made with one to four threads, and Coverstitch, made with two or four threads, as is appropriate.

Starting the process 200, step 201 provides that the lower layer assembly 121 can be formed by joining a plurality of side panels, for example, side (head) panel 123, side panel 124, side panel 125, side (foot) panel 126 and lower sheet 101. Side panels 123, 124, 125, and 126 are configured in a suitable dimension to cover each side and a portion of the bottom of a mattress 9. Side panels 123, 124, 125 and 126 can be formed from stretchable fabric having an elastic component so as to stretch and secure the lower sheet 101 in place on an upper surface of the mattress 9. The lower sheet 101, panel E1, is formed of sheet material, preferably high quality cotton, silk, satin, Dreamfit® or other fabric desired to provide a comfortable feeling between a person and the sheet.

Side (head) panel 123 and side (foot) panel 126 are of an appropriate size and dimension corresponding to the head and foot sides of the mattress 9. Side panels 124 and 125 are of an appropriate size and dimension corresponding to the sides of the mattress 9 other than the head or foot dimensions. Panels 123, 124, 125 and 126 can include additional material so as to allow these side panels to extend around a portion of the bottom of the mattress 9 to form a fitted sheet. Accordingly, lower sheet 101 is of an appropriate size and dimension corresponding to size of the mattress 9 such is standard, full, twin, twin XL, Queen, King, or other dimensions such as California King. It is appreciated that other dimensions or custom dimensions are within the scope of the inventions to form a fitted lower sheet so as to cover the mattress and hold the sheet in place. Straight stitches or other strong flexible stitch can be utilized in forming the seam 127. When completed, the assembled lower layer assembly 120 has the appropriate measurements and shape to form a fitted sheet for the desired size of the mattress 9 such as standard, full, twin, twin XL, Queen, or King.

In each of the processes 220 and 270 is input to step 202, the lower sheet 101 is joined by a seam 127 to the side panel assembly 121. Process 220 illustrates a side panel assembly 121 made from multiple sheets of material comprising head (side) panel 123, side panel 124, side panel 125, and foot (side) portion 126. The seam 127 joining the elongated edge of the side portions 123, 124, 125 and 126 and the lower sheet 101 as is shown in FIG. 7 corresponding to step 223 of process 220 of FIG. 11.

The process of manufacture 200 in FIG. 6 includes variations of the process to join the expansion layer assembly 150 between the lower sheet assembly 121 and 160. As is illustrated in FIGS. 28 and 29 as well as shown in FIGS. 4, 5A-5C, 28 and 29, step 202 can input a side panel assembly from process 206 or 207 or 220. In a multi-panel configuration, the product of step 253 is input into process 220 at steps 224 of FIG. 11 and FIGS. 8, 12-17 for joining to the lower sheet 101 in step 202. Specifically, in step 224, expansion layer assembly 150 from step 253 of manufacturing processes 230, 240, and 250 is joined to the lower sheet 101 as shown in FIGS. 6, 7-17, 26 and 27. Similarly in a unitary construction, step 202 inputs the process 206 component of a unitary side panel assembly 121 from process 300 as shown in FIGS. 6, 20C and 21 in another embodiment of the present invention. According to yet another embodiment, in a two-piece construction, step 202 inputs the component of process 207, a two-piece side panel assembly 121 from process 310, as shown in FIGS. 6, 22C and 23. According to still yet another embodiment, step 202 inputs the component of process 207, a two-piece corner seam side panel assembly 121 from process 320, as shown in FIGS. 6, 24C and 25.

As illustrated in FIGS. 6, 7 and 11, steps 221, 222, and 223 in the process of manufacturing 220 the side assembly 121 is formed from multiple sheets of material. In step 221, referring to FIGS. 7 and 11, the component panels of material are cut, which panels include lower sheet 101, side head panel 123, side panel 123, side panel 124, and side foot panel 125 to the proper dimension of the bed such as, for example, dimensioned for a queen size mattress 9. In step 222, the side panels 123, 124, 125 and 126 are aligned on a long edge around the perimeter edge of the lower sheet 101. In step 223, the lower sheet 101 and the side panels 123, 124, 125 and 126 are joined by stitching lower sheet seam 127 around the perimeter edge of the lower sheet 101. This assembly identifies side portion opposite edges 128 and 129 used for reference and alignment in step 224.

As illustrated in FIGS. 6, 8 and 11, step 225 in the process of manufacturing 22) uses a side panel seam 156 to stitch the expansion layer assembly 150 to the joined lower sheet 101 and side panels 123, 124, 125 and 126 from step 223. Step 224 accepts an input component made from step 253. Each expansion flap section 152, 153 is arranged to have edges 138 and 139 align with edges 128 and 129, respectively. Side panel seam 156 joins section 152 at edges 128 and 138 by stitching the expansion flap section 152 to the lower layer assembly. Side panel seam 156 also joins section 153 at edges 129 and 139 by stitching the expansion flap section 153 to the lower layer assembly.

As illustrated in FIGS. 6, 9 and 11, step 226 in the process of manufacturing 220 forms pockets 107 located on the side(s) near the head of the bed for easy access. One or more pockets 107 can be formed in the side panel 124 and 125. Step 225 a pocket seam 157 stitched in the desired pattern forms a pocket 107 in the side panel 124. Similarly, pocket seam 157 can be stitched in the desired pattern forming the pocket 107 in the side panel 125. Each expansion flap section 152, 153 is aligns over the lower sheet 101 and panels 124 and 125. Specifically, individual side panels 138 and 139 overlay side panels 124 and 125, each being joined by pocket seam 157. In this manner the pockets 107 can be formed from the existing side panel material.

As illustrated in FIGS. 6, 10 and 11, step 226 in the process of manufacturing 220 a corner seam 158 forms the corners of a fitted sheet by joining edges the head (side) panel 123, side panel 124, side panel 125, and foot (side) portion 126. Additionally, the corner seam 158 forms the elongated pockets 117 and 118. In step 226, the corner seam 158 can be stitched to join adjacent edges of side panels 123, 124, 125 and 126 forming corners thereby. Specifically, the corner seam 158 is stitched to join adjacent edges of side panels 123, 124, edges of side panels 123, 125, edges of side panels 124, 126 and edges of side panels 125, 126. As shown in FIGS. 4, 5A through 5C, the corner seam 158 also operates to form the elongated pockets 117 and to form an elongated head pocket 118 in the side 111. As a result multiple seams are used to join edges of the side panel so as to form a fitted sheet and encompass the mattress 9.

Also illustrated in FIGS. 6, 10 and 11, in step 227 in the process of manufacturing 220 a gathering seam 159 joins the gathering means 122 to the free edges of the side(s). In step 227, a gathering seam 159 stitching the gathering means 122 to the free edges 128 and 129 of the side panels 124 and 125 and the other free edges of panels 123, 126 to join these and form a perimeter. Gathering means 122 can be elastic, drawstring, elastic ribbon and the like. In step 227, a gathering seam 159 can stitch one or more elastic portions to form a gathering fitted sheet at the bottom of the bed. Alternatively, in step 227, a gathering seam 159 can stitch a drawstring to the free edges of the side(s), which when drawn closed, gathers edges at the bottom of the mattress. Alternatively, in step 227, a gathering seam 159 can stitch an elastic ribbon to the free edges of the side(s) at each corner to secure the lower layer assembly 120 to the mattress 9.

As illustrated in FIGS. 12 and 13, in the process of manufacturing 230 steps 231, 232, 233 and 234 form a zipper pocket layer assembly 130 side pocket layer panels 131, 132 and attachment means 133, 134. In step 231, side pocket layer panels 131, 132 are cut from stretchable material to a predetermined dimension, for example, dimensioned for a queen size mattress 9. In step 232, side pocket layer panels 131, 132 are aligned on a long edge with attachment means 133, 134 such as enclosure zipper(s) operating to open and closing the bed covering system whereby the expansion panel is tucked into side panels 109 and 110. The enclosure zippers 133, 134 can be conventional zipper, zip, or zip fastener, for binding the edges of an opening of fabric or other flexible material. Zippers can be supplied in tape form consisting essentially of two rows of protruding teeth, made to interdigitate, thereby linking the rows of specially shaped metal or plastic teeth. A slider moves along the rows of teeth creating a Y-shaped channel that meshes together or separates the opposing rows of teeth, depending on the direction of the slider's movement. The zipper teeth are disposed on tape made from fabric cloth or other means to extend outwardly so as to be able to be joined by a seam to another piece.

In the manufacturing process of the present invention, the release zippers 143, 144 are oriented to the interior of the bed when the enclosure zippers 133, 144 are in the closed position so as to create the appearance and for the expansion panels 104 to tuck into side panels 109, 110. For example, the tape 133*a*, 134*a* of zipper 133, 134, respectively, are joined on one side by stitching seam 135 to panels 138, 139, respectively, as is shown in FIGS. 12 and 13. The other side of the tape 133*a*, 134*a* remains free for joining to the upper sheet 102 by seam 162 in a later step 262, of FIGS. 26 and 27. Similarly, for example, the tape 143*a*, 144*a* of release zippers 143, 144, respectively, are joined on one side by stitching seam 145 to panels 141, 142, respectively, as is shown in FIGS. 14 and 15. The other side of the tape 143*a*, 144*a* remains free for joining to the upper sheet 102 by seam 162 in a later step 262, of FIGS. 26 and 27. Advantageously, seam 162 can join both the release and enclosure zippers 133, 143 in one step by stitching together tape 133*a*, 143*a* and upper sheet 102 so as to have the release zipper 143 disposed behind enclosure zipper 133 so as to orient it to the interior of the bed when closed. Similarly, seam 162 can join both the release and enclosure zippers 134, 144 in one step by stitching together tape 134*a*, 144*a* and upper sheet 102 so as to have the release zipper 144 disposed behind enclosure zipper 134 so as to orient it to the interior of the bed when in the closed position.

In the manufacturing process, attachment means 133, 134 are aligned to panels 131, 132, respectively, in a predetermined location spaced apart from the top and bottom of the long edge of panels 131, 132. A predetermined location alignment spaces the attachment means 133, 134 apart from the top and bottom of the long edge provides so as to allow a leg to exit at the bottom and for improved, easy access into the bed by a user of the bed covering product 100. In step 233, a seam 135 stitches the attachment means 133, 134 to panels 131, 132 joining them, for example, enclosure zippers 133, 134 along the long edge forming a zipper pocket layer panel 136, 137, respectively. Step 234 ends with the zipper pocket layer assembly 130 having zipper pocket layer panels 136, 137 used in process 250 steps 251, 252 as shown in FIGS. 16 and 17. An opposite edges 138, 139 of each zipper pocket layer panels 136, 137 is identified for steps 251, 252 in process 250 as shown in FIGS. 16 and 17. For the purpose of minimizing stitches panels 148 and 149 shown in FIG. 15 can be joined to side panels 131, 132 at the same time as in step 233 of FIG. 13.

As illustrated in FIGS. 14 and 15, in the process of manufacturing 240 steps 241, 242, 243 and 244 form a zipper expansion layer assembly 140 from expansion layer panels 141, 142 and attachment means 143, 144. In step 241, expansion layer panels 141, 142 are cut from stretchable material to a predetermine dimension, for example, dimensioned for a mid-portion of a queen size mattress 9. In step 242, expansion layer panels 141, 142 are aligned on a long edge with attachment means 143, 144. Referring to FIG. 14, attachment means 143, 144 extend along a long edge of panels 141, 142, respectively. An opposite edge 146 of each expansion layer panel 141, 142 is identified for step 251 in process 250 as shown in FIGS. 16 and 17. Expansion layer panels 141, 142 are made from stretchable, elastic material for improved comfort and use of the bed covering product 100. In step 233, a seam 145 stitches the attachment means 143, 144 to expansion layer panels 141, 142 joining them, for example, release zippers 143, 144 are joined by stitching seam 145 along the long edge of expansion layer panels 141, 142 forming zipper expansion layer panels 148, 149, respectively. Step 234 ends the process forming the zipper expansion layer 140 comprising zipper expansion layer panels 148, 149 used in process 250 and steps 251, 252 as shown in FIGS. 16 and 17.

As illustrated in FIGS. 16 and 17, in the process of manufacturing 250 steps 251, 252, 253 and 254 form an expansion layer assembly 150 by combining zipper pocket layer panels 136, 137 and zipper expansion layer panels 148, 149, respectively. In step 251, zipper pocket layer panels 136, 137 are aligned with expansion layer panels 148, 149, respectively, overlapping opposite edge 146. Opposite edges 138 and 139 of zipper pocket layer panels 136, 137, respectively, are free. In step 252, a seam 151 stitches the zipper pocket layer panels 136, 137 to zipper expansion layer panels 148, 149, respectively, essentially along opposite edge 146. In step 253 the process ends forming the expansion layer assembly 150 comprising expansion panels 152, 153 used in process 220 and steps 224 as shown in FIGS. 8 and 11.

As illustrated in FIGS. 18A, 18B, 18C and 19, in the process of manufacturing 280 steps 281, 282, 283, 284 and 285 form a head pocket assembly by joining a side panel 123 with seam 127. In one embodiment, the head panel 123 is dimensioned to twice the side panel so that it can be folded over at a mid-portion with outer edges joined by stitching pocket seam 157. Alternatively, two panels of the same dimension may be cut, for example, the panel 123 is of the same dimension as panel 123*a*, designated for illustration. Panel 123 can already be attached to the lower sheet 101, for example, in step 223 of FIG. 11. In step 281, side head panels 123, 123*a* are aligned along a long edge thereof as shown in FIGS. 18A and 19. In step 282, side head panels 123, 123*a* are joined along the long edge using a seam, for example, a side panel seam 156 by stitching along a long edge of the overlapped head side panels 123, 123*a* as shown in FIGS. 18B and 19. In step 283, side head panels 123, 123*a* are joined on each side forming pockets by a corner seam 157 as shown in FIGS. 18C and 19. If panel 123 is attached to the lower sheet 101 from step 223 stitching can be accomplished by the corner seam 157 and the gathering seam 159 in steps 226 and 227. In step 254, the process ends forming the head pocket assembly 118 shown in FIGS. 4 and 18C.

Referring to FIGS. 20 through 25, alternative embodiments of the process of manufacturing 300, 310 and 320 for a unitary or two-piece side panel assembly and are described according to the present invention. A side panel assembly 121 of a unitary or two-piece construction has advantages of reduced elements in the process of manufacturing 300, 310 and 320, whereby a single side panel (unitary) or by overlapping side panels two-piece construction can form a side panel to encompass the sides of the mattress 9. The product of the process of manufacturing 300, 310 and 320 forms side panel pockets 117, side head pocket 118 and pockets 107 on sides 109, 110 and 111 in a fitted sheet to encompass the mattress 9. Additionally, expansion layer panels 148, 149 and attachment means 143, 144 can be added by steps 303, 313, or 323 as is shown in FIGS. 20C, 22C, and 24C and in FIGS. 21, 23, and 25, respectively. As shown in step 202 of FIG. 6, the side panel assembly 121 is attached to the lower sheet 101. For example, in process 300, 310 or 320, the side panel assembly 121 is joined to the lower sheet 101 by stitching seam 127 and a corner seam 158 in steps 304, 314, or 324 as is shown in FIGS. 21, 23 and 25 respectively. The corner seam 158 is located at the corner in steps 304, 314, or at mid-panel in step 324, based on alignment of the wrapping of the side panel. Process 300, 310 or 320 produces a lower layer assembly 120 that can be combined with the upper sheet assembly 160 in step 204 as shown in FIG. 6.

Referring to FIGS. 6, 20A through 20D and 21, process of manufacturing 300 a side panel assembly 121 from a unitary sheet of material is described. A side panel assembly 121 of a unitary construction has advantages of reduced elements in the process of manufacturing 300, whereby a single side panel (unitary) can encompass the sides of the mattress 9. The product of the process of manufacturing 300 forms side panel pockets 117, side head pocket 118 and pockets 107 on sides 109, 110 and 111 in a fitted sheet.

In step 301, a side panel assembly 121 is cut from a unitary sheet of material of a predetermined dimension as shown in FIGS. 20A and 21. The side panel assembly 121 is folded over at a mid-portion of the short side of the panel as shown in FIG. 20A. The predetermined dimension is determined by the mattress size, for example, King, Queen, XL Twin, so as to surround at least the sides and a portion of the bottom of the mattress forming a fitted sheet, and in the unitary case the short side should be more than double (2×) the height of the side portion of the mattress 9 so as to cover sides and a portion of the bottom. The sheet of material preferably is stretchable with an elastic component so as to compress around the mattress 9 when the lower sheet assembly applied thereto. In step 301, the gathering means 122 also can be included. Gathering means 122 is aligned and located at the mid-portion of the short side of the panel prior to folding, which will encompass it in the next step 302.

Referring to FIGS. 20B and 21, in step 302, the side panel assembly 121 is joined by stitching seams for the pocket(s) 107, side pockets 117, head side pocket 118, a foot side pocket, and the gathering means. Specifically, in step 302 pocket seam 157 stitches the horizontal and vertical outline of the pockets 107 located near the head of the bead. The side seam 158 essentially forms the side pocket(s) 117, side head pocket 118, a side foot pocket adjacent the corners of the mattress 9. Referring to FIGS. 20B and 21, in step 302, the gathering seam 159 can stitch the gathering means 122 to an edge of the side panel assembly 121. The gathering seam 159 forms a channel for the gathering means 122, for example, elastic, drawstring or the like, thereby joining the lower edge of the panel.

Referring to FIGS. 20C and 21, in step 303, the expansion panels 148, 149 are joined to the side panel assembly 121 by seam 151. The expansion panels 148, 149 are aligned at a predetermined mid-panel location so as to allow easy access near the head of the bed and for a vented area 114 so that a leg can extend out of the bed covering product 100. In step 303, attachment means 134, 135 can be joined to side panel assembly 121 by stitching seam 151 in one operation, as zipper expansion panels 148, 149 already have attachment means 143, 144 from process 240. In this manner, the expansion layer is provided and ready to attach by sewing seam 162 and attachment means 133, 134 to upper sheet 102, for example, as described in process 260 step 262 of FIGS. 26 and 27 and step 204 of FIG. 6.

In step 304, the side panel assembly 121 is joined to the lower layer assembly 120 as shown in FIGS. 20D and 21. The side panel assembly 121 is joined to the lower sheet 101 by stitching seam 127 around the perimeter edge of lower sheet 101. A side seam 158 joins the free short ends of the side panel assembly 121 by stitching these forming a corner of the fitted sheet.

Referring to FIGS. 6, 22A through 22D, and 23, process 310 is another embodiment of manufacturing the sides from two sheets of material. A side panel assembly 121 of a two-piece construction has advantages of reduced elements in the process of manufacturing 310, whereby elongated side panel can encompass the sides of the mattress 9. The product of the process of manufacturing 310 forms side panel pockets 117, side head pocket 118 and pockets 107 on sides 109, 110 and 111 in a fitted sheet.

In step 311, a side panel assembly 121 is cut from two panels of material of predetermined dimension and aligned beginning at one end on top of the other as shown in FIGS. 22A and 23. The predetermined dimension each portion of the side panel assembly 121 is determined by the mattress size, for example, King, Queen, XL Twin, so as to surround the sides and a portion of the bottom of the mattress. The sheet of material preferably is stretchable with an elastic component so as to compress around the mattress 9 when the lower sheet assembly applied thereto. In step 311, the gathering means 122 also can be included. Gathering means 122 is aligned and located between the panels along the long edge, which will encompass it in the next step 312.

Referring to FIGS. 22B and 23, in step 312, the side panel assembly 121 is joined by stitching seams for the pocket(s) 107, side pockets 117, head side pocket 118, a foot side pocket, and the gathering means. Specifically, in step 312 pocket seam 157 stitches the horizontal and vertical outline of the pockets 107 located near the head of the bead. The side seam 158 essentially forms the side pocket(s) 117, side head pocket 118, a side foot pocket adjacent the corners of the mattress 9. The gathering seam 159 joins the gathering means 122, for example, elastic or the like, to the lower edge of the panel. A double gathering seam 159 can form a channel in the lower edge of the panel for the gathering means 122, for example, drawstring or the like.

In step 313, attachment means 134, 135 can be joined to side panel assembly 121 by stitching seam 151 in one operation, as zipper expansion panels 148, 149 already have attachment means 143, 144 from process 240. In this manner, the expansion layer is provided and ready to attach to upper sheet 102, for example, in step 204 of FIG. 6 and as described in process 260 step 262 of FIGS. 26 and 27. In step 314, the side panel assembly 121 is joined to the lower layer assembly 120 as shown in FIGS. 22D and 23. The side panel assembly 121 is joined to the lower sheet 101 by stitching seam 127 around the perimeter edge of lower sheet 101. A side seam 158 joins the free short ends of the side panel assembly 121 by stitching these forming a corner of the fitted sheet.

Referring to FIGS. 6, 24A through 24D and 25, process 320 is yet another embodiment of manufacturing the sides from two sheets of material. A side panel assembly 121 of a unitary construction has advantages of reduced elements in the process of manufacturing 320, whereby elongated side panel can encompass the sides of the mattress 9. The product of the process of manufacturing 320 forms side panel pockets 117, side head pocket 118 and pockets 107 on sides 109, 110 and 111 in a fitted sheet.

In step 321, a side panel assembly 121 is cut from two panels of material of predetermined dimension and aligned centering each panel on top of the other as shown in FIGS. 24A and 25. The predetermined dimension of each panel of the side panel assembly 121 is determined by the mattress size, for example, King, Queen, XL. Twin, so as to surround the sides and a portion of the bottom of the mattress. The sheet of material preferably is stretchable with an elastic component so as to compress around the mattress 9 when the lower sheet assembly applied thereto. In step 321, the gathering means 122 also can be included. Gathering means 122 is aligned and located between the panels along the long edge, which will encompass it in the next step 322.

Referring to FIGS. 24B and 25, in step 322, the side panel assembly 121 is joined by stitching seams for the pocket(s) 107, side pockets 117, head side pocket 118, a foot side pocket, and the gathering means. Specifically, in step 322 pocket seam 157 stitches the horizontal and vertical outline of the pockets 107 located near the head of the bead. The side seam 158 essentially forms the side pocket(s) 117, side head pocket 118, a side foot pocket adjacent the corners of the mattress 9. Referring to FIGS. 22B and 23, in step 322, the gathering seam 159 can stitch the gathering means 122 to an edge of the side panel assembly 121. The gathering seam 159 joins the gathering means 122, for example, elastic or the like, to the lower edge of the panel. A double gathering seam 159 can form a channel in the lower edge of the panel for the gathering means 122, for example, drawstring or the like.

In step 323, attachment means 134, 135 can be joined to side panel assembly 121 by stitching seam 151 in one operation, as zipper expansion panels 148, 149 already have attachment means 143, 144 from process 240. In this manner, the expansion layer is provided and ready to attach to upper sheet 102, for example, in step 204 of FIG. 6 and as described in process 260 step 262 of FIGS. 26 and 27.

In step 324, the side panel assembly 121 is joined to the lower layer assembly 120 as shown in FIGS. 24D and 25. The side panel assembly 121 is joined to the lower sheet 101 by stitching seam 127 around the perimeter edge of lower sheet 101. A side seam 158 joins the free short ends of the side panel assembly 121 by stitching these at a mid-panel location forming the fitted sheet.

Referring now to FIGS. 6, 26 and 27, step 204 of the process 200 joins the expansion layer assembly to the upper sheet 102. The expansion layer assembly from step 203 is ready to join by stitching the attachment means 143 and 144 on the expansion layer panel(s) 148, 149 to the upper sheet 102 as shown in FIGS. 26 and 27. In Step 261, each side of the expansion layer panel(s) 148, 149 are located at a predetermined position relative to the upper sheet. The predetermined position advantageously allows for open and closed position operation, easy entry and exit from the bed, the vented portion for a leg to stick out, and to position expansion assembly correctly along the side of the mattress 9. The attachment means should like up with its corresponding portion, for example, attachment means zippers (133, 143) and (134, 144) aligning zipper for open and closed position operation. The seam 146 is adjacent attachment means 133, 134 for correct orientation. In step 262, upper sheet seam 162 joins each expansion layer panel 148 and 149 to the upper sheet 102 adjacent attachment means 143 and 144, respectively.

Referring to step 263, the bed covering product 100 is produced by the process of manufacturing 200 as described herein. In operation, as shown in FIGS. 5A-5C, 29 and 30, the bed covering product 100 has lower sheet 101 connected to the upper sheet 102 by expansion panel 103 having attachment means 104 so as to close the bed covering product placing the expansion panel 103 along the side(s) 109, 110 of the mattress 9. This operation and configuration advantageously allows for an improved appearance as the expansion panel is not folded on the top of the bed, creating unsightly lumps or distortions, but on the sides. Moreover, the expansion panel 103 can be made of an elastic fabric which stretches when force is applied advantageously allowing for improved comfort when in the bed.

Additional features of the bed covering product 100 can be added after step 204 as shown in FIG. 6. For example, at step 205, the process can include joining connection means 5, 105 to attach and hold to the upper sheet 102 additional products such as a duvet, covers, blankets or other topping products as illustrated in FIGS. 1, 2, 4 and 5A-5C. As described herein, the connection means 5, 105 can be snaps, buttons, hooks, Velcro or the like.

After step 204, a pillow attachment assembly 180 that can be produced by the process of manufacture 280 and added to the bed covering product 100 on the side head portion 123 as is shown in FIGS. 6, 30 and 31. The pillow attachment assembly 180 comprises two portions: one portion is positioned on at least one side of the pillow or pillow case; and the other portion runs along at or near the head portion of at least one corresponding edge of the lower sheet. According to an embodiment of the present invention, the pillow attachment assembly 180 includes a pillow case or enclosure 106, a side head panel handle 181, and a tether 182 adapted to be affixed to the pillow 106 and handle 181. Each of handle 181 can be made from durable woven ribbon material, a ribbon of material with corresponding hook and loop fabric, such as Velcro®, snaps or buttons. Similarly, each tether 182 can be made from durable woven ribbon material, a ribbon of material with corresponding hook and loop fabric, such as Velcro®, snaps or buttons. When pillow attachment assembly 180 is closed (i.e. connected), the pillow is affixed to the head portion of the lower sheet. When the pillow attachment means is open (i.e. unattached), it allows the pillow to be removed from the lower sheet.

For example, the process may be implemented by textile machines in conjunction with a computer control or an apparatus for performing the operations herein. Here operations and processes of blocks 201-205 may be executed synchronously, with processes 220, 230, 240, 250, 260, 270, 280, 300, 310 and 320 executed asynchronously or recursively or otherwise occurring independently of the main program flow 201-105. Asynchronous actions are actions executed in a non-blocking scheme, allowing the main program flow to continue. The apparatus may be specially constructed for the required purposes, or it may comprise a general-purpose computer selectively activated or reconfigured by a computer program stored in the computer. Such a computer program may be stored in a computer readable medium. A machine-readable medium includes any mechanism for storing or transmitting information in a form readable by a machine (e.g. a computer). For example, a machine-readable (e.g., computer-readable) medium includes a machine (e.g., a computer) readable storage medium (e.g., read only memory ("ROM"), random access memory ("RAM"), magnetic disk storage media, optical storage media, flash memory devices, etc.), a machine (e.g., computer) readable transmission medium (electrical, optical, acoustical or other form of propagated signals (e.g., carrier waves, infrared signals, digital signals, etc.)), etc. However, it is not so limited; other mechanisms such as may be implemented in software, hardware, or a combination thereof.

It should be borne in mind, however, that all of these and similar terms are to be associated with the appropriate steps and physical quantities and are merely convenient labels applied to these steps and quantities. Unless specifically stated otherwise as apparent from the above discussion, it is appreciated that throughout the description, discussions utilizing tenns such as "joining" or "sewing" or "assembling" or "putting" or "tucking" or "making" or "forming" or "aligning" or "seam" or "sheet" or "panel" or "edge" or "pocket" or drawstring" or "zipper" or "elastic" or the like, refer to the action and processes that manipulates and transforms the physical material, which can be implemented in a computer system, or similar electronic computing device, with steps, data, and measurements queued in a computer system, or implemented by a special machine, that represent physical (electronic) quantities within the computer system's registers and memories into other data similarly represented as physical quantities within the computer system memories or registers or other such information storage, transmission or display devices.

According to one embodiment, lower sheet 1 may be fabricated from any standard sheet materials such as cotton, linen, flannel or satin. It comprises (i) a major surface which covers the top of the mattress and (ii) four sides which cover the sides of the mattress and/or box spring. Lower sheet 1 preferably comprises four elastic portions located at the lower corners of each of the sides of lower sheet 1, preferably able to be tucked well under the mattress and/or box spring. These elastic portions are most preferably located at each of lower four corners of lower sheet 1 and fit over the four corresponding lower corners of the mattress. These elastic portions preferably fit over the lower corners of the mattress so as to removably attach the lower sheet to the mattress in a manner similar to a fitted sheet. The lower sheet is fabricated and shaped to fit snugly over the mattress such that it is removably attached to the mattress.

According to another embodiment, lower sheet 1 can be shaped such that the mattress fits within the lower sheet's inner cavity. In this embodiment, the lower sheet 1 forms a cavity on its interior and the mattress is slipped into the cavity of the lower sheet 1 via an opening (9) in one side of the lower sheet.

According to one embodiment, the upper sheet 2 may similarly be fabricated and from standard sheet materials such as cotton, linen, flannel or satin. In the alternative, the upper sheet 2 may be fabricated from any blanket material or from comforter materials as exists presently in a blanket or comforter or featherbed. Upper sheet 2 comprises (i) a major surface which is located above or lies on top of the major surface of the lower sheet 1 and (ii) four edges. At least two of the edges of upper sheet 2 are attached through expandable flap 3, to the corresponding two sides of lower sheet 1. The fourth edge of upper sheet 2 is not attached to lower sheet 1.

If an edge of upper sheet 2 is attached directly to lower sheet 1 it can be attached by attachment means including but not limited to sewing, zipper, Velcro, buttons or snaps. If an edge of upper sheet 2 is attached to an expandable flap, then the expandable flap is attached to both an edge of upper sheet 2 and a side of lower sheet 1 by an attachment means including but not limited to sewing, zipper, Velcro, buttons or snaps.

According to one embodiment, the bedding materials preferably comprise at least one expandable flap 3 located between at least one edge of upper sheet 2 and a side of lower sheet 1. More preferably, the bedding materials comprise at least two expandable flaps 3 located between the edges of upper sheet 2 and the sides of lower sheet 1 which run along the two sides of the bed where persons enter and exit the bed. Most preferably the bedding materials comprise two expandable flaps along the two sides of the bed where persons enter and exit the bed as noted previously and one expandable flap 3 (*a*) located between the edge of upper sheet 2 and the side of lower sheet 1 at the foot of the bed. The expandable flaps of material 3 can be made of a stretchable material, which will allow the upper sheet to move away from the lower sheet by a specified distance. The expandable flap 3 in this regard can also be an integral part of the upper sheet 2, with no clear demarcation between the upper sheet 2 and the expandable flap 3. The expandable flaps 3 can be made of an elastic fabric which stretches when force is applied. Preferably the expandable flap or flaps located along the sides of the bed where persons enter and exit the bed. The expandable flaps 3 may be attached to the upper sheet 2 and the lower sheet 1 by an attachment means 4 such as sewing a zipper Velcro or snaps to them. Optionally, an expandable flap 3 can have a slit in a portion of the expandable flap which will allow a user to place a leg outside of the bedding materials, through the slit, while sleeping.

The bedding materials also comprise at least one attachment means, such as a zipper 4, preferably two zippers, with the zipper or zippers located on the sides of the bedding materials corresponding to where people normally enter and exit the bed. The zipper 4 comprises an upper zipper portion and a lower zipper portion. The upper zipper portion runs along at or near at least one of the edges of upper sheet 2 where people normally enter and exit the bed and the lower zipper portion runs along the corresponding side of lower sheet 1. The zipper 4 is situated such that when it is zippered, it pulls upper sheet 2 into close contact with lower sheet 1, and expandable flap 3 folds, contracts, or tucks neatly behind zipper 4. When unzippered, zipper 4 releases expandable flap 3 and thus upper sheet 2 so that upper sheet 2 can move freely above lower sheet 1 to the extent of expandable flap 3. The zipper 4 can also be partially zippered to control the available play between upper sheet 2 and lower sheet 1. For appearance and neatness it is important that the expandable flap folds, contracts or tucks behind the zipper (i.e. fold in towards the mattress) so that it is hidden and pulled together when the zipper is zipped. As noted, it is preferable that the bedding materials comprise two zippers and two expandable flaps with one located on each side of the bedding materials where persons normally enter and exit from the bed. As alternatives to the zipper, the bedding materials may use equivalent attachment means such as Velcro, snaps, hooks or buttons. The zipper is preferred for its ease, safety and reliability. If attachment means other than a zipper are used, the attachment means will generally have two portions such as a row of button holes and a corresponding row of buttons, or a row of male snaps and a corresponding row of female snaps, or corresponding strips of Velcro. One portion runs along at least one side of the lower sheet and the other portion runs along at or near at least one corresponding edge of the upper sheet. When one portion of the attachment means is connected to the other portion of the attachment means, the means is closed and the expandable flap folds in behind the attachment means while the upper sheet is pulled tightly against the lower sheet. When the two portions of the attachment means are unattached, it is open and the expandable flap is released to allow the upper sheet to move away from the lower sheet to the extent of the expandable flap.

According to another embodiment, instead of a zipper any other attachment means such as Velcro, snaps or buttons can be used to attach the upper sheet to a side of the lower sheet. When the attachment means is closed (i.e. connected), the upper sheet is pulled tightly against the lower sheet. When the attachment means is open (i.e. unattached), it allows the upper sheet to move away from the lower sheet to the extent allowed by the expandable flaps. The attachment means should comprise two portions. One portion runs along at least one side of the lower sheet and the other portion runs along at or near at least one corresponding edge of the upper sheet. When one portion of the attachment means is connected to the other portion of the attachment means, the means is closed and the upper sheet is pulled tightly against the lower sheet. When the two portions of the attachment means are unattached, it is opened and the upper sheet is allowed to move away from the lower sheet to the extent of the expandable flaps.

According to another embodiment, the upper sheet 2 may optionally comprise snaps, buttons, hooks, Velcro or other connection means 5 which are located near the edges of upper sheet 2. These snaps or buttons 5 can be used to attach an additional blanket and/or a bed covering to upper sheet 2 which is part of the original one piece system of the invention. An additional blanket or bed covering may be provided with corresponding connection means which correspond with, and attach to, the connection means 5 on the upper sheet 2.

The edge of upper sheet 2 and the side of lower sheet 1 which are located at the foot of the bed can optionally be connected to each other through an expandable flap, 3(*a*). Flap 3(*a*) is preferably made from a stretchable fabric or stretchable fabric mesh. In the alternative, a slit or opening can be placed in flap 3(*a*) at the foot of the bed for air flow.

The sides of lower sheet 1 can optionally have pocket 7 which are preferably fabricated from the same material as lower sheet 1. Pocket 7 can be used to hold or store various items such as a television control or glasses. Pocket 7 is preferably located on the side(s) of lower sheet 1 near the head of the bed for easy access. More than one pocket can be used on each side.

Lower sheet 1 may also optionally have a pillow cover or pillow sham encasement 6 attached to it on its major surface at the head of the bed. Preferably the pillow or pillow encasement 6 are removably attached to the top edge of the upper peripheral side panel at the head of the bead of lower sheet 6 by snaps or buttons (not shown).

The lower sheet 1 may also optionally comprise a dust ruffle 8 which is attached at the bottom of the sides of lower sheet 1. This dust ruffle serves the aesthetic purpose of covering the sides of the bed and the functional purpose of minimizing dust accumulation under the bed.

As is shown in FIG. 28, according to an embodiment of the present invention, a comforter or duvet assembly 163 can be adapted and configured from the upper layer assembly 160 using upper sheet 102 and an additional upper sheet 102*a*. The comforter assembly 163 is formed from upper sheets 102, 102*a* joined by stitching comforter seam 164 on an outer peripheral edge of at least three sides thereof so as to form a pocket. A batting or fill layer 165 can be placed prior to stitching between the sheets 102, 102*a*. The batting or comforter fill layer 165 can be suitable material sufficient provide warmth, airflow and the like, as desired. It is advantageous to join attachment means 133, 143 and 134, 144 to the underside of the upper sheet 102 prior to the entire a comforter or duvet assembly 163 being stitched together by comforter seam 163 so as to avoid stitching in the upper layer 102*a* to upper layer 102.

What has been described above includes examples of the invention. It is of course not possible to describe conceivable combination of components or methodologies for purposes of describing the present invention but of ordinary skill in the art may recognize that many combinations and permutations of the present invention are possible. Accordingly the present invention is to embrace all such alterations modifications and that fall within the spirit and scope of the claims. Furthermore to the extent that the term includes is used in either the detailed description or the such term is intended to be inclusive in a manner to the term comprising as comprising is interpreted when employed as a transitional word in a claim.

I claim:

1. A process of manufacturing a bed covering system comprising the steps of:

joining a lower sheet and a side panel assembly shaped to fit upon and substantially cover the top, sides and a portion of the underside of any mattress by stitching the side panel assembly to a peripheral edge of the lower sheet to form a lower layer assembly;

joining the lower layer assembly and an expansion panel by stitching the expansion panel to an exterior edge of the side panel assembly on opposite sides of the bed; the side panel assembly configured to place the expansion panel along a side of the bed, said joining the lower layer assembly and an expansion panel by stitching at least one attachment means to two side panels thereby forming a releasable side pocket panel, and stitching a releasable pocket layer to said releasable expansion panel thereby forming a releasable expansion panel assembly;

joining an upper sheet to the expansion panel so as to attach the expansion panel both the lower sheet and upper sheet forming a vented area at a foot end of the mattress on a transverse side adjacent the side panel assembly on opposite sides of the bed by said joining of said upper sheet to the expansion panel as joined to said exterior edge of the side panel assembly on opposite sides of the bed; and joining the at least one attachment means to the exterior edge of the side panel and the upper sheet so as to allow opening and closing the bed covering system, whereby said joining of said at least one attachment means is on at least one of said opposite sides of the bed.

2. The process of manufacturing a bed covering system of claim 1, wherein the step of joining the lower layer assembly includes the step of:

cutting a plurality of panels for the sides and lower sheet of a predetermined dimension;

aligning a long edge of side panels around a perimeter of the lower sheet; and stitching a sheet seam on the perimeter of the lower sheet to join the side panels thereto.

3. The process of manufacturing a bed covering system of claim 2, wherein the step of joining the lower sheet layer includes the step of:

joining a head pocket by stitching a head pocket assembly to the lower layer assembly at the head portion.

4. The process of manufacturing a bed covering system of claim 1, further including the step of: joining snaps, buttons, hooks, hook and loop fastener, or other connection means which are located adjacent the edges of said upper sheet.

* * * * *